US006332067B1

(12) United States Patent
Domoto

(10) Patent No.: US 6,332,067 B1
(45) Date of Patent: Dec. 18, 2001

(54) PASSIVE MANAGEMENT OF TRANSFUSE BELT TEMPERATURE DISTRIBUTION

(75) Inventor: Gerald A. Domoto, Briarcliff Manor, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/705,264

(22) Filed: Nov. 3, 2000

(51) Int. Cl.[7] ..... G03G 15/20; G03G 15/16

(52) U.S. Cl. ..... 399/307; 219/216; 399/329; 430/124

(58) Field of Search ..... 399/307, 328, 399/329, 320; 219/216; 430/124; 347/156

(56) References Cited

U.S. PATENT DOCUMENTS 4,567,349 * 1/1986 Henry et al. ..... 219/216
5,157,447 * 10/1992 Farnand et al. ..... 219/216 X
5,708,950 * 1/1998 Badesha et al. ..... 399/307 X
6,002,907 * 12/1999 Berkes ..... 399/307
6,118,955 * 9/2000 Yoneda et al. ..... 399/329 X

* cited by examiner

*Primary Examiner*—Sophia S. Chen
(74) *Attorney, Agent, or Firm*—Perman & Green, LLP

(57) ABSTRACT

A printing apparatus includes a toner image producing station for forming a toner image. The apparatus includes an image bearing member for supporting the toner image; and a transfuse station for simultaneously transferring and fusing the toner image to a substrate transfuse station. The substrate transfuse station has: (i) a transfuse member; (ii) a heating roll adapter to heat the transfuse member; (iii) a cooling roll adapted to cool the transfuse member; and (iv) at least one phase change roll adapted to both heat and cool the transfuse member, each of the rolls in contiguous contact with the transfuse member and adapted to move the transfuse member. Included are embodiments for a method of passively managing the temperature distribution on a transfuse member and the transfuse system itself.

31 Claims, 4 Drawing Sheets

PASSIVE MANAGEMENT OF TRANSFUSE BELT TEMPERATURE DISTRIBUTION

BACKGROUND OF THE INVENTION

1. Field of the Invention

The present invention relates to electrophotographic printing and more specifically, this invention relates to electrophotographic printers which include a transfusing member and a system for managing the temperature distribution on the transfusing member.

2. Prior Art

Electrophotographic marking is a well known and commonly used method of copying or printing original documents. Electrophotographic marking is typically performed by exposing a light image of an original document onto a substantially uniformly charged photoreceptor. In response to that light image the photoreceptor discharges so as to create an electrophotographic latent image of the original document on the photoreceptor's surface. Examples of electrostatic formation of latent images are disclosed in U.S. Pat. Nos. 4,408,214, 4,365,549, 4,267,556, 4,160,257 and 4,155,093. Toner particles are then deposited onto the latent image so as to form a toner powder image. That toner powder image is then transferred from the photoreceptor, either directly or after an intermediate transfer step, onto a marking substrate such as a sheet of paper. The transferred toner powder image is then fused to the marking substrate using heat and/or pressure. The surface of the photoreceptor is then cleaned of residual developing material and recharged in preparation for the creations of another image.

The foregoing generally describes a typical black and white electrophotographic marking machine. Electrophotographic marking can also produce color images by repeating the above process once for each color that makes the color image. For example, the charged photoconductive surface may be exposed to a light image which represents a first color, say cyan. The resultant electrostatic latent image can then be developed with cyan toner particles to produce a cyan image which is subsequently transferred to a marking substrate. The foregoing process can then be repeated for a second color, say magenta, then a third color, say yellow, and finally a fourth color, say black. Beneficially each color toner image is transferred to the marking substrate in superimposed registration so as to produce the desired composite toner powder image on the marking substrate. Processes for forming monochromatic or polychromatic electrostatic images are disclosed, for example, in U.S. Pat. Nos. 3,672,887, 3,687,661, 4,395,472, 4,353,970, 4,403,848 and 4,286,031.

The color printing process described above superimposes the various color toner powder images directly onto a marking substrate. Another electrophotographic color printing process uses an intermediate transfer member. In systems which use an intermediate transfer member successive toner images are transferred in superimposed registration from the photoreceptor onto the intermediate transfer member. Only after the composite toner image is formed on the intermediate transfer member is that image transferred and fused onto the marking substrate.

The most common developing materials are dry powder toners. Dry powder developers are typically comprised of not only toner particles but also of carrier granules. The toner particles triboelectrically adhere to the carrier granules until the toner particles are attracted onto the latent image. An alternative to dry powder developing materials are liquid developers. Liquid developers, also referred to as liquid inks have a liquid carrier into which toner particles are dispersed. When developing with liquid developers both the toner particles and the liquid carrier are advanced into contact with the electrostatic latent image. The liquid carrier is then removed by blotting, evaporation, or by some other means, leaving the toner particles behind.

Intermediate transfer members can also be used in the fusing process. Intermediate transfer members which are used in fusing are referred to herein as transfusing members, and the combined processes of transferring and fusing is called transfusing. Transfusing is highly desirable since the size and cost of transfusing printing machines can be less than comparable printing machines which use a separate transfer station and fusing station. Other advantages such as improved image quality can also be obtained by transfusing. Transfusing members are usually pinched between one or more contact rollers and a backup roller such that a fusing pressure is created between the nip of the backup roller and the transfusing member. During fusing a marking substrate passes between the backup roller and the transfusing member and heat is applied to the toner image. The combination of heat and pressure causes the toner image to fuse onto the marking substrate. Transfusing may be done without heat, but the resulting quality is usually inferior.

One problem with transfusing members is that the transfusing member usually needs to be hot to provide high-quality fusing. The heat can damage the photoreceptor and can interfere with the transfer process. Other problems with transfusing members, are due to the fact that the application of transfuse members requires both heating and cooling of the member. Higher temperatures (e.g. 120° C. to 200° C.) are required for fusing, while reasonably lower temperatures (e.g. 40° C.) are required for a development process or a transfer process of the image from a photoreceptor to a transfuse member. Thus, temperature distribution and fluctuations on a transfuse member is a critical issue. In view of this, an efficient means of managing the transfuse member temperature distribution would enable wider applicability of the transfuse process. Since the transfuse member may be used for imaging purposes, any sliding type of contact should be avoided to assure good motion quality. In accordance with the features and advantages offered by the present invention, a passive means of effectively moving heat from high temperature portions of the transfuse member to low temperature portions of the transfuse member thereby reducing heating and cooling requirements, is described.

SUMMARY OF THE INVENTION

All of the foregoing stated advantages, improvements and others will be attained by employing a printing apparatus comprising a toner image producing station for forming a toner image and having an image bearing member for supporting the toner image and a transfuse station for simultaneously transferring and fusing the toner image to a substrate, the transfuse station including (i) a transfuse member; (ii) a heating roll adapter to heat the member; (iii) a cooling roll adapted to cool the member; and (iv) at least one phase change roll adapted to both heat and cool the transfuse member, each of the rolls in contiguous contact e.g. rolling contact or sliding contact, with said member and adapted to move the transfuse member.

Another embodiment of the present invention for achieving these advantages comprises a method of passively managing the temperature distribution on a transfuse member as used in a printing apparatus for simultaneously transferring and fusing a toner image on a substrate comprising: providing a heating roll to heat the member; providing a cooling roll to cool the member; and providing at least one phase change roll adapted to both heat and cool the member whereby heat is passively moved from higher temperature portions of the member to lower temperature portions of the transfuse member, while using e.g. rolling contact.

Still another embodiment of the present invention comprises a transfuse system for simultaneously transferring from a receptor and fusing a toner image onto a substrate, the system comprising: (i) a transfuse belt; (ii) a heating roll adapted to heat the belt; (iii) a cooling roll adapted to cool the belt; and (iv) at least one phase change roll adapted to both heat and cool the transfuse belt whereby heat is passively moved from higher temperature portions of the belt to lower temperature portions of the belt.

BRIEF DESCRIPTION OF THE DRAWINGS

Other aspects of the present invention will become apparent as the following description proceeds upon reference to the drawings, in which.

DETAILED DESCRIPTION OF THE PREFERRED EMBODIMENTS

Figure 1:
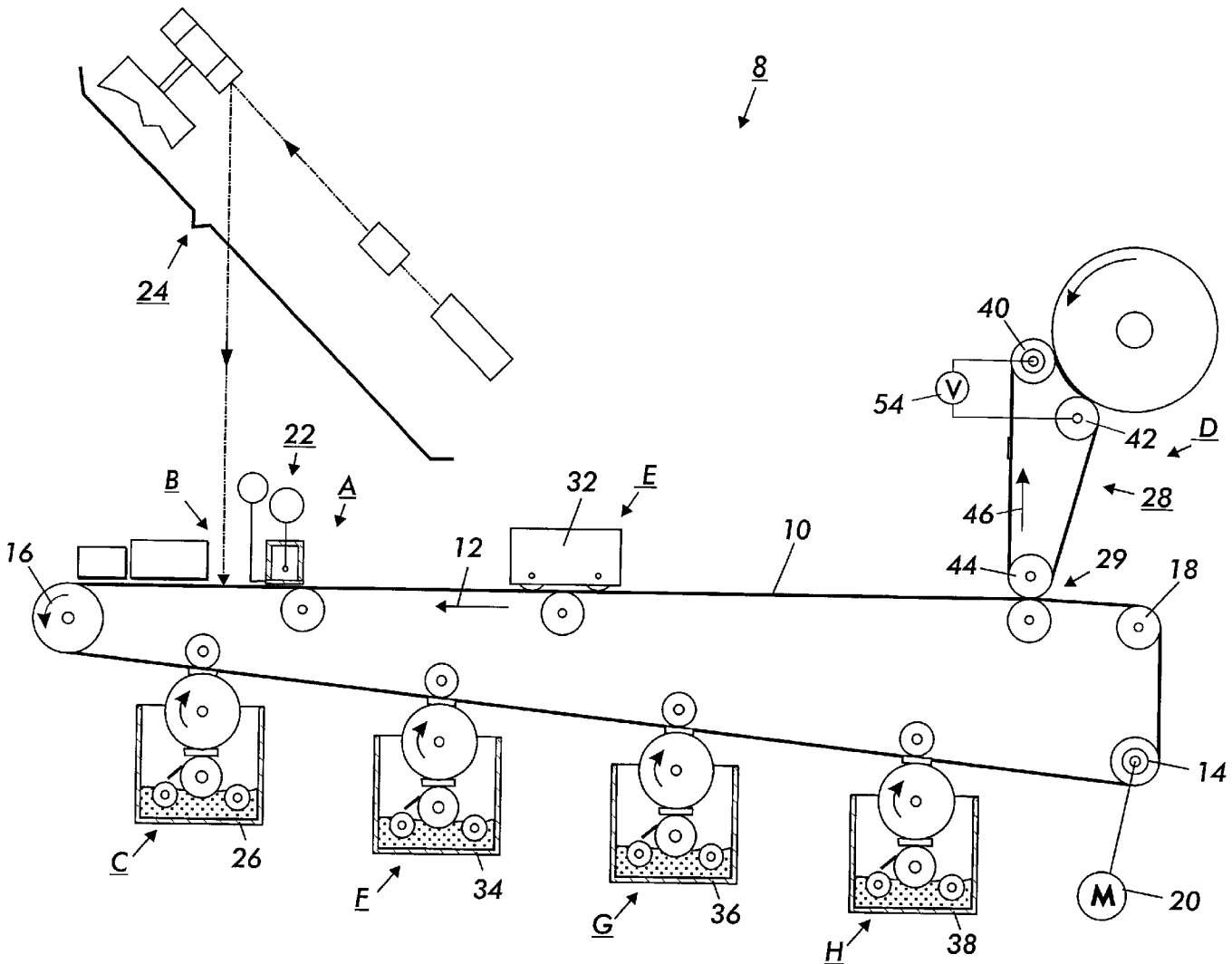
FIG. 1 schematically depicts a multiple pass electrophotographic color printing machine which can incorporate the principles of the present invention.

FIG. 1 illustrates a multiple pass color electrophotographic printing machine 8 that copies an original document. Although the principles of the present invention are well suited for use in such electrophotographic copiers, they are also well suited for use in other printing devices, including electrophotographic printers. Therefore it should be understood that the present invention is not limited to the particular embodiment illustrated in FIG. 1 or to the particular application shown therein.

The printing machine 8 includes a charge retentive surface in the form of an Active Matrix (AMAT) photoreceptor 10 which has a photoconductive surface and which travels in the direction indicated by the arrow 12. Photoreceptor travel is brought about by mounting the photoreceptor about a drive roller 14 and two tension rollers, the rollers 16 and 18, and then rotating the drive roller 14 via a drive motor 20.

As the photoreceptor moves each part of it passes through each of the subsequently described process stations. For convenience, a single section of the photoreceptor, referred to as the image area, is identified. The image area is that part of the photoreceptor which is operated on by the various process stations to produce a developed image. While the photoreceptor may have numerous image areas, since each image area is processed in the same way a description of the processing of one image area suffices to explain the operation of the printing machine.

As the photoreceptor 10 moves, the image area passes through a charging station A. At charging station A a corona generating scorotron 22 charges the image area to a relatively high and substantially uniform potential, for example about −500 volts. While the image area is described as being negatively charged, it could be positively charged if the charge levels and polarities of the other relevant sections of the copier are appropriately changed. It is to be understood that power supplies are input to the scorotron 22 as required for the scorotron to perform its intended function.

After passing through the charging station A the now charged image area passes to an exposure station B. At exposure station B the charged image area is exposed to the output of a laser based output scanning device 24 which illuminates the image area with a light representation of a first color image, say black. While FIG. 1 shows the exposure station as using laser light from an output scanning system, other optical projecting and exposure systems, such as an array of light emitting diodes, can also be used. That light representation discharges some parts of the image area so as to create an electrophotographic latent image.

After passing through the exposure station B, the now exposed image area passes through a first development station C. The first development station C advances negatively charged development material 26, which is comprised of black toner particles, onto the image area. The development material is attracted to the less negative sections of the image area and repelled by the more negative sections. The result is a first toner image on the image area. The development material 26, and all of the subsequently described development materials, could be either powder or liquid. If the development material is a powder toner then the toner image is substantially pure toner particles. However, if the development material is liquid the toner image is comprised of toner particles and a liquid carrier.

After passing through the first development station C the image area advances to a transfusing station D. That transfusing station includes a charged (by a device, devices, or method which, while not shown, can be any of those known in the art) transfusing member 28 which may be a belt, as illustrated in FIG. 1, or a drum. As the image area passes by the transfusing member the first toner image is transferred onto the transfusing member. The transfusing station D is described subsequently.

After the first toner image is transferred to the transfusing member 28 the image area passes to a cleaning station E. The cleaning station E removes any residual development material from the photoreceptor 10 using a cleaning brush contained in a housing 32.

After passing through the cleaning station E the image area repeats the charge-expose-develop-transfer sequence for a second color of developer material (say magenta). Charging station A recharges the image area and exposure station B illuminates the recharged image area with a light representation of a second color image (magenta) to create a second electrostatic latent image. The image area then advances to a second development station F which deposits a second negatively charged development material 34, which is comprised of magenta toner particles, onto the image area so as to create a second toner image. The image area and its second toner image then advances to the transfusing station D where the second toner image is transferred onto the transfusing member 28 in superimposed registration with the first toner image.

The image area is again cleaned by the cleaning station E. The charge-expose-develop-transfer-clean sequence is then repeated for a third color (say yellow) of development material 36 using development station G, and then for a fourth color 38 (say cyan) of development material using development station H.

The operation of the transfusing station D will now be described in detail. The transfusing member 28 is entrained between a first conductive roller 40, a second conductive roller 42, and a transfer roller 44. The transfer roller is rotated by a motor, which is not shown, such that the transfusing member rotates in the direction 46 in synchronism with the movement of the photoreceptor 10. The synchronism is such that the various toner images are registered with each other after they are transferred onto the transfusing member 28. As previously mentioned the transfusing member is biased to attract charged toner from the photoreceptor.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy track of the position of the documents and the copy sheets. In addition, the controller regulates the various positions of the gates depending upon the mode of operation selected.

In carrying out the objectives of the present invention, a method, apparatus and system are described herein which simultaneously transfers and fuses an image from an image bearing member to a substrate by a transfuse member, such as a transfuse belt, upon which the temperature distribution has been passively managed.

The image bearing member, e.g. a photoreceptor can be made of many well known dielectric materials which may comprise a material from the group consisting of an acrylic resin, a polycarbonate resin, MYLAR, and a transparency material. The image receptor may also comprise a ground plane of a support material such as aluminum, titanium, or chromium. The substrate may comprise paper, metal, plastic, or glass. The image bearing member may be in various forms, such as a web, a belt, a drum, a plate or a sheet.

The application of transfuse belts requires both heating and cooling of the belt. High temperatures are required for fusing while reasonably low temperatures are required for either development or transfer. An efficient means of managing the belt temperature distribution would enable wider applicability of the transfuse process. Since the belt may be used for imaging purposes, sliding contact to effect temperature changes should be avoided to assure good motion quality. A passive means of effectively moving heat from high temperature portions of the belt to low temperature regions using rolling contact is described herein and illustrated by the transfuse system shown in FIG. 2.

Figure 2:
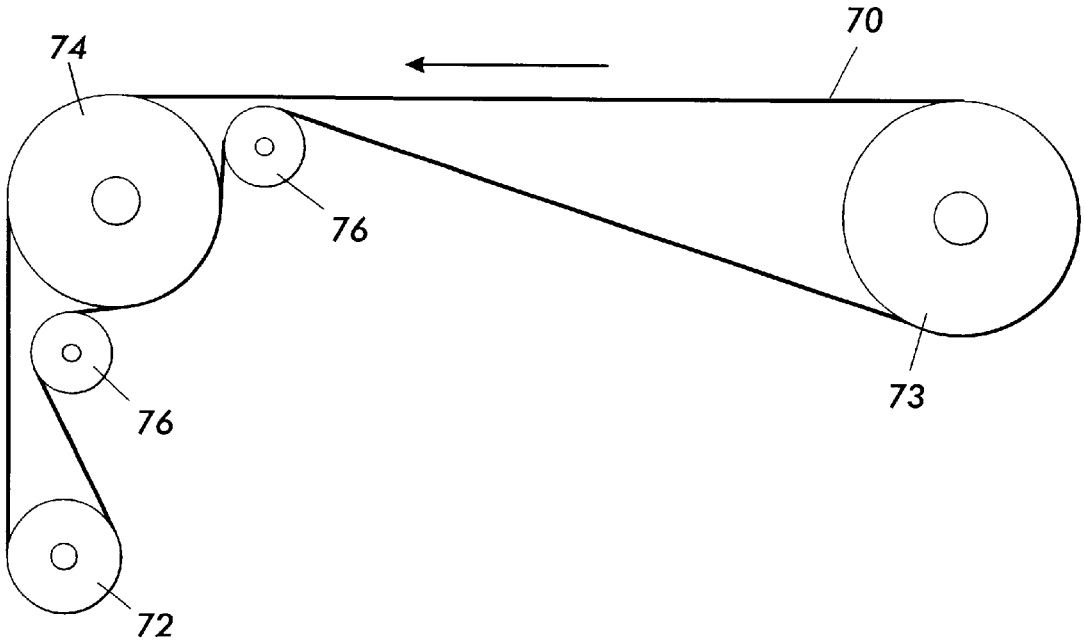
FIG. 2 schematically depicts a transfuse belt traveling on a series of rollers in accordance with the features of the present invention.
Figure 2A:
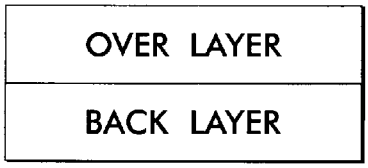
FIG. 2A is a cross sectional plan view of a transfuse belt.

As shown is FIG. 2, a rolling contact heat pipe is used in accordance with the features of the present invention to transfer the heat from hotter portions of the transfuse belt 71 to cooler regions. The belt 71 is assumed to be relatively thin and heated by the transfuse roll 72 to 120° C. (may be higher for powder applications, e.g. 200° C.) and cooled by the cold roll 73 to, for example, about 40° C. In the absence of the phase change roll 74 and neglecting losses, for example, 1000 watts of heating and 1000 watts of cooling must be provided to maintain this temperature distribution. With the phase change roll 74 in place in accordance with the features of the present invention, the cool portions of belt 71 will be heated by the phase change roll 74 from about 40° C. to about 80° C. while the hot portions of the belt will be cooled by contact with the phase change roll 71 from about 120° C. to about 80° C. The heating and cooling requirements will be reduced by a factor of 2 to 500 watts. Two phase change rolls in the system would reduce heating and cooling requirements by a factor of 3 to 333 watts. Also shown in FIG. 2 are rolls 76 which employ pressure against transfuse belt 71 to keep the belt 71 in close contact with heating roll 72, phase change roll 74 and cooling roll 73. In accordance with the features of this invention more than two phase change rolls can be used.

The rolling contact heat pipe 74 may be operated using water or any other appropriate fluid to help transfer the heat. The rotary motion of the roll enhances the effectiveness of the heat pipe by providing means for transport of liquid away from the condensing area at the top of the roll to the evaporating area at the bottom of the phase change roll. In the orientation shown, gravity also aids in conveying the condensing liquid to the heated region. For orientations where the liquid transport must oppose gravity a wick or porous lining must be added to the inside surface of the roll to retain liquid via surface tension and allow roll motion to convey liquid to the top of the roll.

Figure 3:
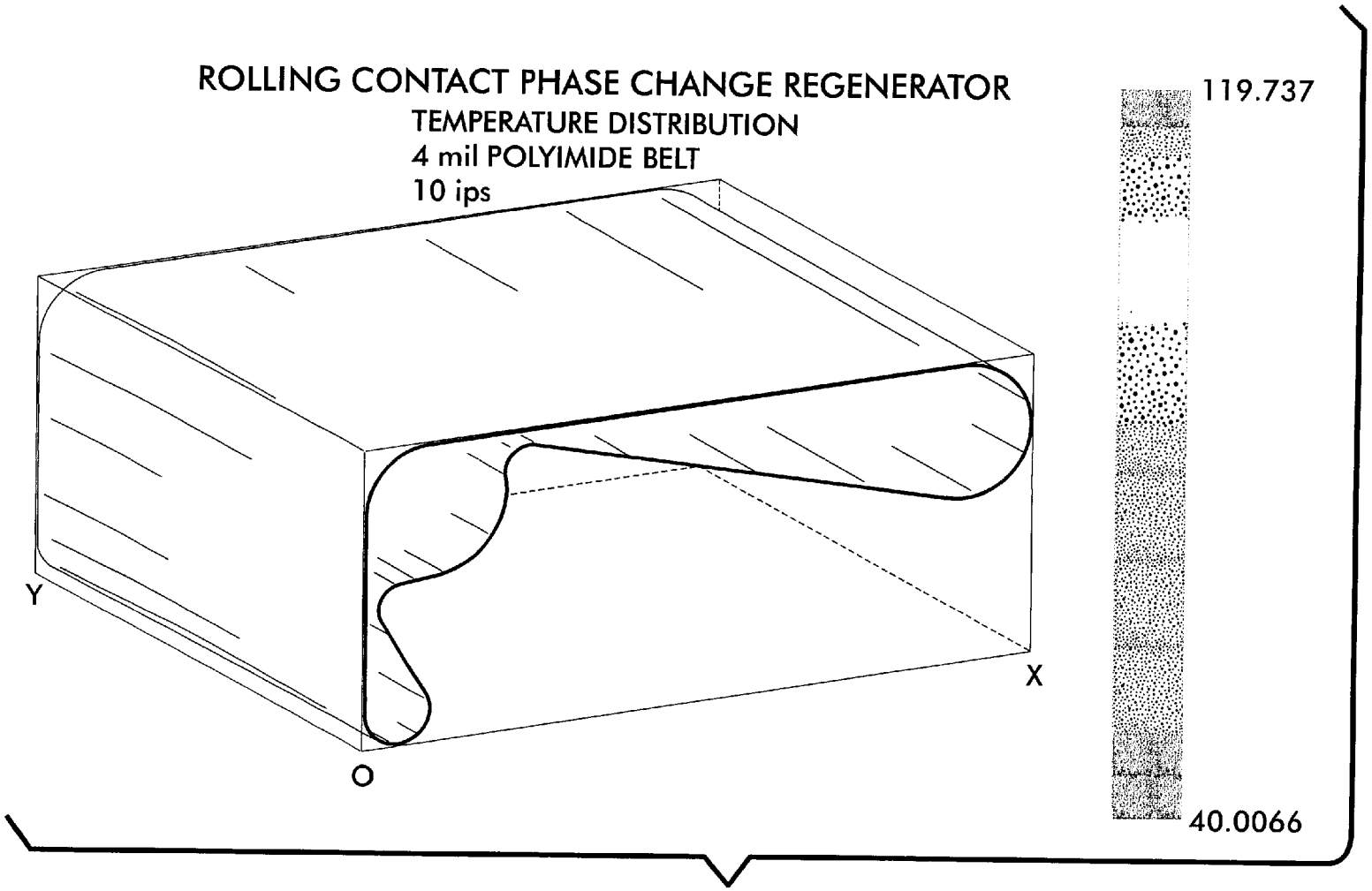
FIG. 3 is a plan view of a three dimensional thermal simulation of the transfuse system in accordance with the features of the present invention having one phase change roll illustrating temperature distribution.

A three dimensional thermal simulation of the system with, as an example, one phase change roll is shown in FIG. 3. For the thickness and speed shown, the outer surface temperature of the belt attains the temperature of the contacting rolls in a short distance after beginning in contiguous contact with the transfuse belt. Very high heat transfer coefficients for boiling and condensation within the phase change roll are responsible for the isothermal condition of the phase change roll.

FIG. 3 shows the results of a three dimensional thermal simulation of a transfuse belt system incorporating the rolling contact phase change regenerator as described above and in accordance with the features of the present invention. In this example, the belt was moving in a counterclockwise direction at 10 inches per second. For this simulation, the belt was polymide with a thickness of 0.004 inches. The cooling roll was maintained at 40° C. while the transfuse roll was maintained at 120° C. The three dimensional, time transient, heat conduction equation was solved for this moving belt system. The results showed the predicted steady state temperature distribution on the outer surface of the belt with the rolls removed. The temperature is shown in color according to color bar. Red indicates 119.737° C. while blue is 40.0066° C. In this case green is halfway up the scale at 80° C. We see that the belt leaves the cooling roll at a temperature close to 40° C. The temperature of the outer belt surface rises to 80° C. after contacting the phase change roll. We also see that the belt contacts the transfuse roll and attains a temperature near 120° C. and travels to the phase change roll again. The heat is removed from the belt at the phase change roll and the belt temperature drops to 80° C. The phase change roll can support very high heat transfer rates due to evaporations and condensation mechanisms. In this case the belt is thin enough so that at 10 inches per second, the belt is cooled throughout its thickness by the phase change roll from 120° C. to 80° C. and also heated throughout its thickness from 40° to 80° C. For very thick belts and very high speeds the thermal resistance of the belt material will limit the effectiveness, however this can be counteracted by higher thermal conductivity belts and longer contact zone with the phase change roll.

Figure 4:
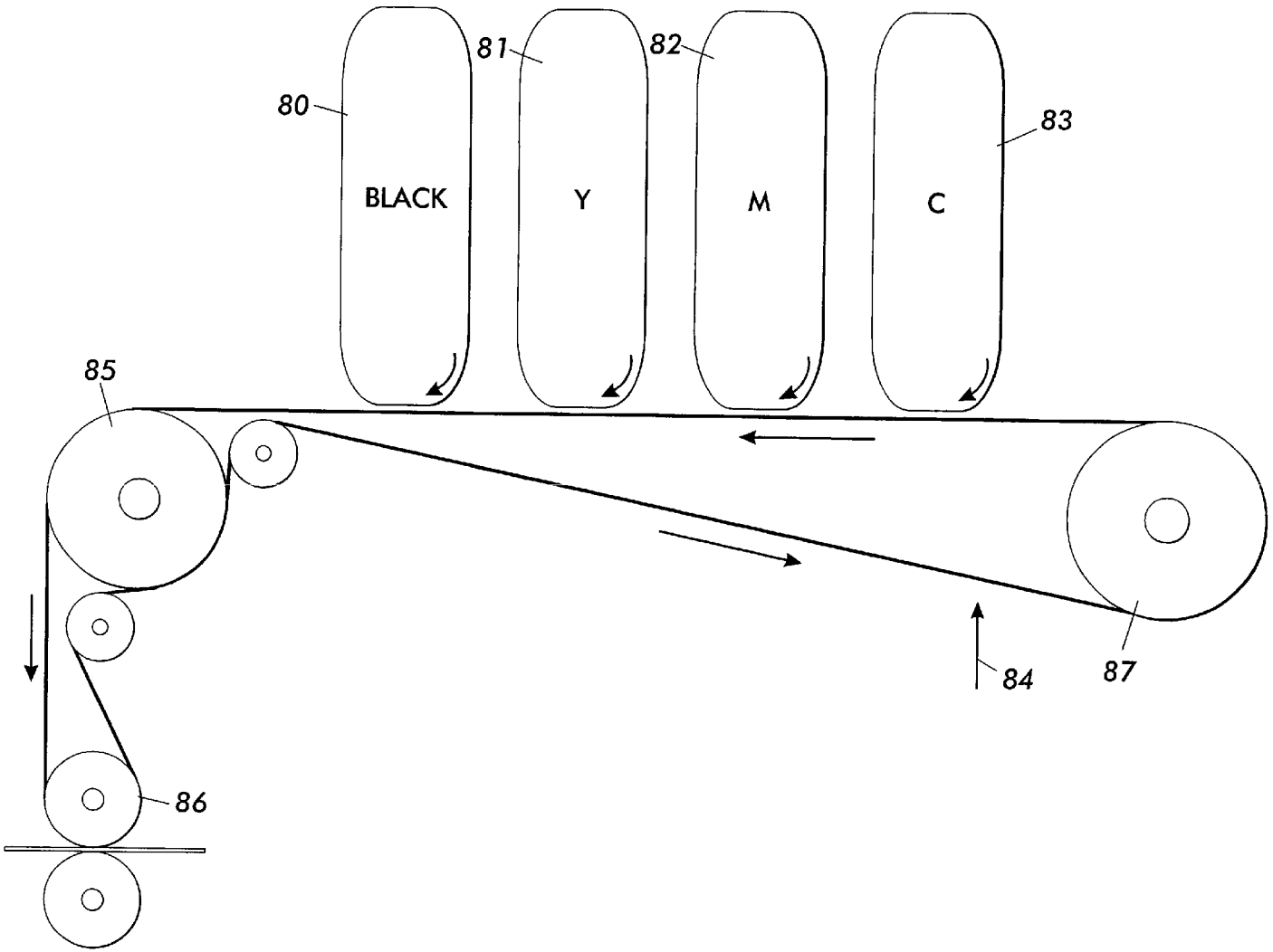
FIG. 4 schematically depicts an example of a single pass electrophotographic color printing machine incorporating the features of the present invention.

FIG. 4 illustrates a single pass color system which consists of multiple electrophotographic image forming modules 80,81,82 and 83, a single intermediate transfuse belt 84, a phase change roll 85, a fusing roll 86, a cooling roll 87, and means for transfuse belt cleaning. Each electrophotographic module contains a photoreceptor belt or drum, charging means, exposing means (either LED bar or laser scanner), charge development with either dry or liquid toner and cleaning of the photoreceptor belt or drum. Separate color toner images (usually cyan, magenta, yellow and black) are formed on the photoreceptor of each electro-photographic module (these are normally color separations) and each single color image is transferred (either by electrostatics or electrostatics and pressure) to the transfuse belt in good registration. The transfuse belt must be at relatively low temperature during contact with the photoreceptor surfaces. Since the toner image of each color separation must be transferred onto the previously transferred image on the transfuse belt, the motion quality of the transfuse belt as well as the motion quality of the electroreceptors must be well maintained to achieve a high degree of registration between the color separations making up the final full color toner image. Sliding contact is acceptable but susceptible to stick-slip and other friction induced vibration problems affecting belt motion and ultimately image registration and quality. Rolling contact avoids these friction induced problems as well as minimizing the wear of the transfuse belt. This system operates continuously and produces full color images in a single pass fashion.

While this invention has been described in conjunction with specific embodiments thereof, it is evident that many alternatives, modifications, and variations will be apparent to those skilled in the art. Accordingly, the present invention is intended to embrace all such alternatives, modifications and variations that fall within the spirit and broad scope of the appended claims.

What is claimed is:

1. A printing apparatus comprising:

a toner image producing station for forming a toner image and having an image bearing member for supporting the toner image; and a transfuse station for simultaneously transferring and fusing the toner image to a substrate, the transfuse station including:

(i) a transfuse member;

(ii) a heating roll adapted to heat the transfuse member;

(iii) a cooling roll adapted to cool the transfuse member; and (iv) at least one rotary phase change roll adapted to both heat and cool the transfuse member, each of the heating, cooling and phase change rolls adapted to move the transfuse member.

2. A printing apparatus according to claim 1 wherein said transfuse member is a belt.

3. A printing apparatus according to claim 2 wherein said belt is rotated about said heating, cooling and phase change rolls.

4. A printing apparatus according to claim 1 wherein said transfuse member is in rolling contact with a photoreceptor in the form of a belt.

5. A printing apparatus according to claim 4 wherein said belt has a back layer and an over layer, said over layer having a thickness greater than about 0.1 mm.

6. A printing apparatus according to claim 1 wherein there are a plurality of said toner image producing stations.

7. A printing apparatus according to claim 1 wherein said transfuse station includes at least two of said phase change rolls.

8. A printing apparatus according to claim 1 wherein said heating, cooling and phase change rolls are adapted to rotate said transfuse member.

9. A printing apparatus according to claim 1 wherein each of said phase change rolls passively moves heat on said transfuse member from higher temperature areas of said transfuse member to lower temperature areas of said transfuse member.

10. A printing apparatus according to claim 1 wherein said heating roll heats said transfuse member to a temperature of about 120° C. to about 200° C.

11. A printing apparatus according to claim 1 wherein said cooling roll cools said transfuse member to a temperature of about 40° C.

12. A printing apparatus according to claim 1 wherein said phase change rolls are adapted to cool said transfuse member from about 120° C. to about 80° C.

13. A printing apparatus according to claim 1 wherein said phase change rolls are adapted to heat said transfuse member from about 40° C. to about 80° C.

14. A printing apparatus according to claim 1 wherein said phase change rolls are adapted to cool said transfuse member from about 200° C. to about 120° C.

15. A printing apparatus according to claim 1 wherein said phase change rolls are adapted to heat said transfuse member from about 40° C. to about 120° C.

16. A printing apparatus according to claim 1 wherein each of said phase change rolls operates by using a liquid to cause the temperature change.

17. A printing apparatus according to claim 1 wherein said image bearing member is a photoreceptor or intermediate belt.

18. A printing apparatus according to claim 1 wherein the image bearing member comprises a material from the group consisting essentially of a polycarbonate resin, an acrylic resin, and a transparency material.

19. A printing apparatus according to claim 1, wherein said substrate comprises paper, metal, plastic or glass.

20. A printing apparatus according to claim 1, wherein the image to be produced on said substrate is of a single color.

21. A printing apparatus according to claim 1, wherein the image to be produced on said substrate is multi-colored.

22. A method of passively managing the temperature distribution on a transfuse member as used in a printing apparatus for transferring and fusing a toned image layer on a substrate simultaneously, comprising:

providing a heating roll to heat said member;

providing a cooling roll to cool said member; and providing at least one rotary phase change roll adapted to both heat and cool said member whereby heat is passively moved from higher temperature portions of said member to lower temperature portions to said member.

23. The method according to claim 22 wherein a surface of said substrate with the fused image is further modified by post-processing.

24. The method according to claim 22 wherein said substrate comprises paper, metal, plastic or glass.

25. The method according to claim 22 wherein the image to be produced on said substrate is of a single color.

26. The method according to claim 22 wherein an image layer that is produced on said substrate is multicolored.

27. The method according to claim 26 wherein the image layer is multi-colored and fully formed on a photoreceptor before transferring the image layer to said transfuse member.

28. The method according to claim 26 wherein the image to be produced on said substrate is multicolored and each color is separately transferred from a photoreceptor to said substrate.

29. The method according to claim 28 wherein a color layer is at least partially cured before the next successive color transfer.

30. The method according to claim 22, wherein the image layer on a photoreceptor is partially cured before contacting said substrate.

31. A transfuse system for simultaneously transferring from a receptor and fusing a toner image onto a substrate comprising:

(i) a transfuse belt;

(ii) a heating roll adapted to heat said belt;

(iii) a cooling roll adapted to cool said belt; and (iv) at least one rotary phase change roll adapted to both heat and cool said belt whereby heat is passively moved from higher temperature portions of said belt to lower temperature portions of said belt.

* * * * *